United States Patent [19]

Morgan et al.

[11] 4,107,694

[45] Aug. 15, 1978

[54] SEPARABLE BRACKET FOR SUPPORTING AN ANTENNA ON A VEHICLE TRUNK LID

[75] Inventors: Lewis Coleman Morgan, Sherwood; Clarence Arthur Reed, N. Little Rock, both of Ark.

[73] Assignee: Arthur W. Reed Machine Co., Little Rock, Ark.

[21] Appl. No.: 803,745

[22] Filed: Jun. 6, 1977

[51] Int. Cl.[2] ..... H01Q 1/32

[52] U.S. Cl. ..... 343/715; 248/223.4; 248/534

[58] Field of Search ..... 343/713, 715, 880; 248/203, 223.4, 225.1, 534, 539

[56] References Cited

U.S. PATENT DOCUMENTS

| | | | |
|---|---|---|---|
| 3,369,247 | 2/1968 | Bacow | 343/715 |
| 4,028,705 | 6/1977 | Loyd | 343/715 |
| 4,028,706 | 6/1977 | Dolle | 343/715 |
| 4,064,811 | 12/1977 | Copeland | 248/539 |

*Primary Examiner*—Eli Lieberman

[57] ABSTRACT

The invention provides essentially a two-piece separable mount for detachably fixing a vehicle accessory, such as a "CB" radio antenna, to a body part of a vehicle, e.g., the lid of the vehicle trunk.

8 Claims, 6 Drawing Figures

SEPARABLE BRACKET FOR SUPPORTING AN ANTENNA ON A VEHICLE TRUNK LID

BACKGROUND OF THE INVENTION

The recent popularity of CB radios has been followed by a like popularity of theft of the antennae and often the radio itself. The mere presence of an antenna on a vehicle left unattended not only exposed the antenna to theft but also advertises the fact that the vehicle is equipped with a CB radio.

There have been prior efforts made to develop a readily detachable means for mounting the antenna, characterized by means enabling the antenna to be detached from the trunk lid and stored or "hid" in the trunk. Some of the prior mounts, however, leave much to be desired in the way of low cost, convenience and ruggedness and very often attachment and detachment require the use of special tools, drilling of holes, detachment of the antenna lead, etc.

BRIEF SUMMARY OF THE INVENTION

A preferred embodiment of the invention is disclosed here in conjunction with its use on an automobile trunk lid, because the trunk lid is used in the vast majority of cases as a suitable location. A hood mounting could as well be used but this presents problems of interference with driver visibility and the engine compartment does not afford a suitable hiding place for the detached antenna, especially where the hood cannot be locked from within the vehicle.

The invention provides a base to be mounted on an edge of the trunk lid by concealed (inside the trunk) fasteners. A slide part is detachably mounted on the exposed face of the base by cooperative tongue and groove means, and the parts are so constructed that they can be assembled and detached only when the trunk lid is open, because the slide part has a lip or tab that, when the lid is closed, fits into the usual groove or recess around the trunk compartment into which the lid is received when closed.

DESCRIPTION OF A PREFERRED EMBODIMENT

As noted above, the invention is disclosed in connection with those portions of a typical automobile body comprising a trunk 10 and trunk lid 12. As is conventional, the open top of the trunk is bordered by a peripheral recess 14 into which the lid fits when closed, leaving the peripheral edge of the lid bordered by a peripheral groove 16.

Figure 3:
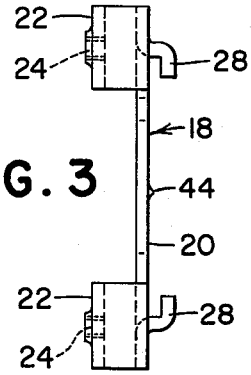
FIG. 3 is an end view of the base part.
Figure 2:
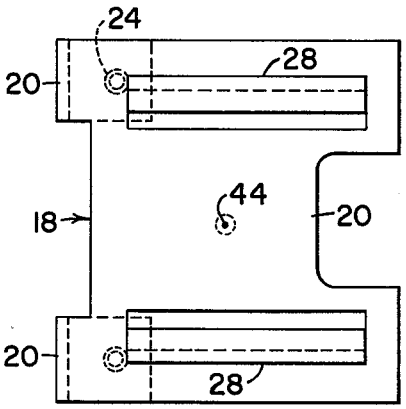
FIG. 2 is a plan view of the base part alone.
Figure 5:
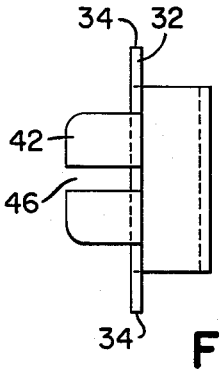
FIG. 5 is an end view of the slide part.
Figure 4:
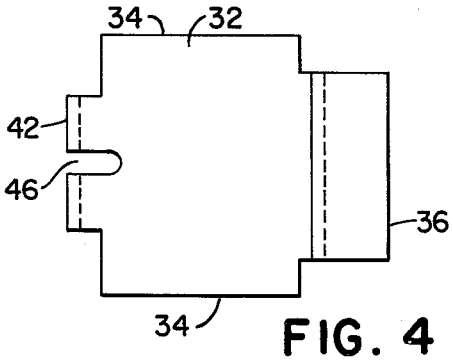
FIG. 4 is a plan of the slide part.
Figure 6:
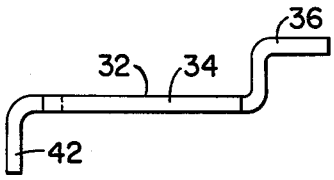
FIG. 6 is a side elevation of the slide part.

The mounting parts are preferably of twenty-five gauge steel, bright zinc plated to resist rust and corrosion. The one part 18 includes a base 20 and a pair of spaced-apart, integral hook portions 22 adapted to hook over and under a peripheral edge portion of the lid (FIG. 1), and the hook portions are drilled and tapped at 24 (FIGS. 3 and 4) to receive a pair of screws 26 from below, the screws thus being concealed and inaccessible when the lid 12 is closed. The screws also provide for an adequate electrical ground between the lid and the base part 18.

The upper or outer face of the base 20 has a pair of integral bent-over lips 28, spaced apart to provide a pair of parallel grooves 30 running normal to the edge of the base having the hooks 22. At their opposite ends the lips 28 merge back into the base and thus close the grooves 30 at those ends, thereby providing a stop to limit insertion of a slide part 32 into the base grooves.

The slide 32 is formed of one-piece steel like the base part 18, and its main body portion is defined at opposite sides by a pair of straight parallel edges 34 that have a sliding fit in the base lips and grooves 28 and 30, when the part are assembled (FIG. 1), the relationship being that of a tongue and groove.

One end of the slide has an integral Z-shaped portion 36 on which the accessory (here a radio antenna 38) is mounted, as by screws 40 from below so as to be virtually inaccessible when the parts 18 and 32 are in place. The other end of the slide 32 is an integral bent-down ear, tab or lip 42 which when the parts are assembled and the lid 12 closed, is received between the base hooks 22 and in the associated part of the groove 16 that borders the peripheral edge of the closed lid. Thus, the slide cannot be removed when the lid is closed.

The top side of the base is formed with a "dimple" 44 which, in cooperation with the underside of the slide, forms a detent for stabilizing the parts and for minimizing inadvertent separation of the parts when the lid is open.

Figure 1:
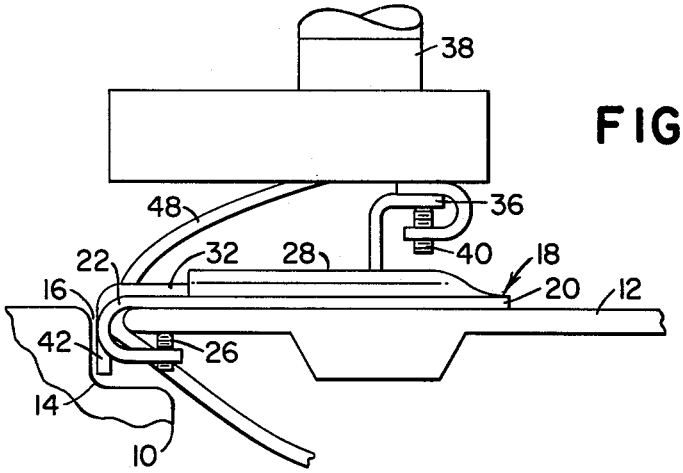
FIG. 1 is a side elevation of the assembled mount as attached to a trunk lid.

A further feature of the invention is that the lip or tab 42 on the slide 32 is bifurcated to provide a slot or opening 46 through which the antenna lead 48 is retained as it passes into the interior of the trunk (FIG. 1). Because the slot is open-ended at its bottom and exposed to the exterior at its top, there is no need to disconnect the antenna lead. (The usual gasket or seal within the recess 14 is not shown. It will be understood that the gasket does not present an obstacle to the antenna lead).

In use, the base part 18 is affixed to the open truck lid at any chosen location thereon, and the screws 26 are securely tightened. The antenna is fixed to the Z portion of the slide 32 by the screws 40. With the trunk lid open, the slide is fitted into the base 20 via the tongue and groove means 30–34 until the slide tab or lip 42 is received between the spaced-apart base hooks 22 and substantially abuts the proximate edge of the lid. The lead from the antenna is placed in the opening 46 and the lid is closed. Because of retention of the antenna lead by the slot 46, there is no danger of pinching the lead.

Since the slide tab or ear is received in the trunk/lid groove 16, the slide cannot be withdrawn so long as the lid remains closed. Because the base grooves 30 are closed at their ends where the groove-forming lips merge back into the base 20, ready access to the slide, as by a prying tool, is denied.

Dismounting of the slide 32, together with the antenna mounted thereon, is easily accomplished when the lid is open, simply by withdrawing the slide outwardly from the base 20. The antenna lead is easily slipped out of the slot 46 and the antenna is stored in the trunk and the lid closed and locked.

We claim:

1. For use in a vehicle having a body portion defining an open-topped compartment bordered by a peripheral recess and a lid shaped to fit within the access in such manner as to leave a peripheral groove, said lid being hinged at one edge to the body portion for opening and closing the compartment: an accessory mount comprising a first part having a base adapted to overlie a portion of the lid and an integral hook portion for receiving and hooking over a peripheral edge portion of the lid, said hook portion having means for securing the first part to the adjacent under-portion of the lid, a second part overlying the base and having an integral depending ear proximate to the hook portion for depending into the proximate portion of the compartment groove and means on said second part for carrying an accessory, cooperative disengageable elements respectively on the two parts for selective engagement and disengagement only when the lid is open, said lip, being received in the groove when the lid is closed, preventing disengagement of the parts.

2. An accessory mount according to claim 1, in which the first part has a pair of spaced-apart similar hook portions and the ear depends between the hook portions.

3. An accessory mount according to claim 1, including detent means between the upper surface of the base and the undersurface of the second part for confining the parts against inadvertent disengagement when the lid is open.

4. An accessory mount according to claim 1, in which the depending ear is bifurcated to provide a slot opening to both the interior and exterior of the compartment when the lid is closed.

5. An accessory mount according to claim 1, in which the disengageable elements comprise cooperative tongue and groove portions slidably engageable and disengageable along a path generally normal to the lid edge to which the first part is secured.

6. An accessory mount according to claim 5, in which the first part has a pair of spaced-apart similar hook portions and the ear depends between the hook portions.

7. An accessory mount according to claim 5, including detent means between the upper surface of the base and the undersurface of the second part for confining the parts against inadvertent disengagement when the lid is open.

8. An accessory mount according to claim 5, in which the depending ear is bifurcated to provide a slot opening to both the interior and exterior of the compartment when the lid is closed.

* * * * *